US005401179A

United States Patent [19]

Shinchi et al.

[11] Patent Number: 5,401,179

[45] Date of Patent: Mar. 28, 1995

[54] LOCKING MECHANISM FOR A CONNECTOR ASSEMBLY OF LOW ENGAGING/DISENGAGING FORCE TYPE

[75] Inventors: Akira Shinchi; Hiroki Takahashi, both of Shizuoka, Japan

[73] Assignee: Yazaki Corporation, Tokyo, Japan

[21] Appl. No.: 103,716

[22] Filed: Aug. 10, 1993

[30] Foreign Application Priority Data

Aug. 19, 1992 [JP] Japan ..... 4-220076
Feb. 10, 1993 [JP] Japan ..... 5-022739

[51] Int. Cl.[6] ..... H01R 13/629

[52] U.S. Cl. ..... 439/157; 439/372; 439/923

[58] Field of Search ..... 439/157, 372, 476, 923

[56] References Cited

U.S. PATENT DOCUMENTS 5,230,635 7/1993 Takenouchi et al. ..... 439/372 X

FOREIGN PATENT DOCUMENTS 1640411 5/1970 Germany .
1964529 1/1971 Germany .
3527916 2/1987 Germany .
52-133993 10/1977 Japan .
56876 2/1990 Japan ..... 439/372
0256875 2/1990 Japan .
2278674 11/1990 Japan .
0472479 6/1992 Japan .

*Primary Examiner*—Steven C. Bishop
*Attorney, Agent, or Firm*—Sughrue, Mion, Zinn, Macpeak & Seas

[57] ABSTRACT

Disclosed is a locking mechanism for a connector assembly of low engaging/disengaging force type comprising a pair of connectors which are engaged with each other; an engaging drive lever having cam grooves and a lock engaging piece is swingably mounted on one of the connectors, and the other connector has driven pins which are engaged with the cam grooves, and a lock which includes a flexible locking piece formed upright in the outer wall of the other connector, and a lock releasing part extended from the free end portion of the flexible locking piece. After the connectors have been engaged with each other, with a locking protrusion of the lock engaging part engaged with the flexible locking piece the lock releasing part is depressed to move the flexible locking piece across the direction of a force of holding the connectors locked, to release the connectors from each other.

4 Claims, 4 Drawing Sheets

FIG. 5B
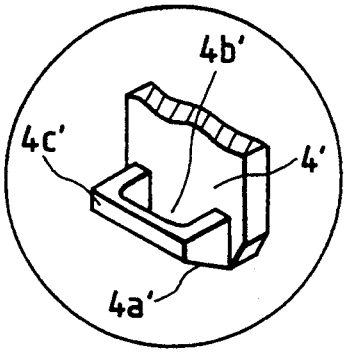
FIG. 5A
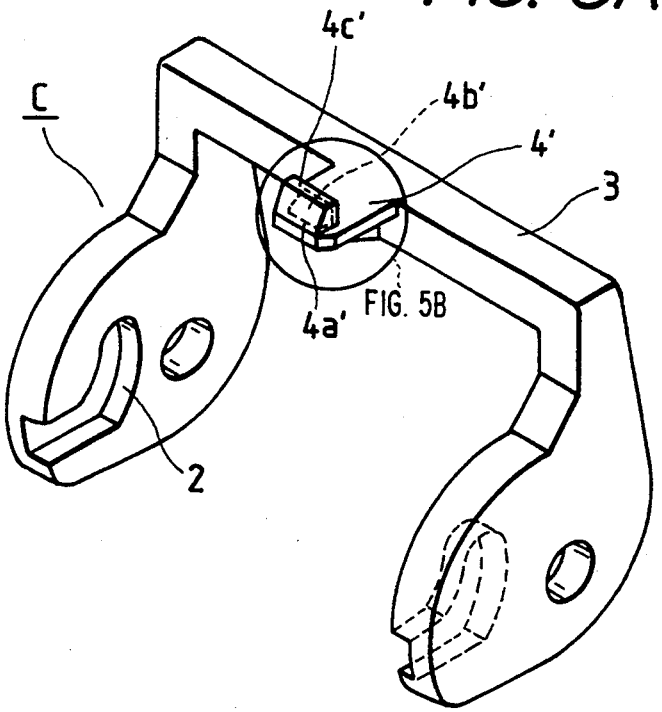
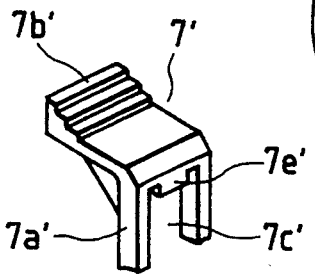
FIG. 5C
FIG. 6
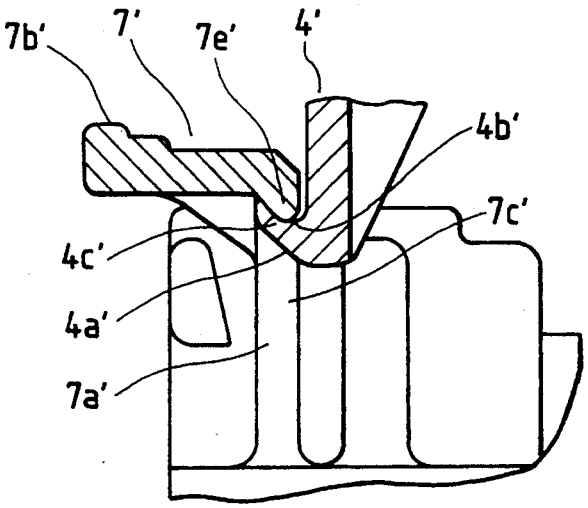

LOCKING MECHANISM FOR A CONNECTOR ASSEMBLY OF LOW ENGAGING/DISENGAGING FORCE TYPE

BACKGROUND OF THE INVENTION

1. Field of the Invention

This invention relates to a locking mechanism in a lever-operated connector assembly of low engaging-/disengaging force type through which wire harnesses are connected to each other or a wire harness is connected to an electrical device.

2. Related Art

As shown in FIG. 7 (cf. Unexamined Japanese Utility Patent Application Sho. 52-133993), an engaging drive lever c is swingably mounted on a male connector a through supporting pins, and driven pins e are protruded from a female connector d.

In engaging the male and female connectors a and d with each other, first the driven pins e are placed in the open end portions of cam grooves $c_1$, which are formed in the drive lever c. Under this condition, the drive lever c is turned. In this operation, since the driven pins e are engaged with the cam grooves $c_1$, the female connector d is moved towards the male connector a. That is, the lever action of the drive cams c causes the male and female connectors a and d to engage with each other by a low engaging force, and the locking part f of the engaging drive lever c is locked to a retaining spring g (as shown in FIG. 8).

The male and female connectors a and d thus engaged are disengaged as follows: That is, the drive lever c thus locked is turned in the opposite direction; that is, the locking mechanism is released. In this operation, the direction X of a force of holding the connectors locked (hereinafter referred to as "a locking holding force", when applicable) coincides with the direction of the operation of releasing the connectors thus locked. Therefore, if the locking force is increased, then it becomes difficult to release the connectors; and the connectors cannot be released without decrease of the locking force.

SUMMARY OF THE INVENTION

In view of the foregoing, an object of this invention is to provide a locking mechanism for a lever-operated connector assembly comprising a pair of connectors which is not only able to increases the locking force but also able to release the connectors from each other with ease.

An object of the invention is to provide a locking mechanism for a connector assembly of low engaging-/disengaging force type comprising:

a pair of connectors engageable with each other;

an engaging drive lever having cam grooves and a lock engaging piece being swingably mounted on one of the connectors, the other connector having driven pins which are engageable with the cam grooves, and lock means including a flexible locking piece formed upright in the outer wall of the other connector, and a lock releasing part extended from the free end portion of the flexible locking piece, after the connectors have been engaged with each other, a locking protrusion of the lock engaging piece engaged with the flexible locking piece the lock releasing part is depressed to move the flexible locking piece across the direction of a force of holding the connectors locked, to release said connectors from each other.

The locking mechanism is so modified that, when the pair of connectors are engaged with each other, an engaging recess formed in the engaging surface of the locking protrusion is engaged with an engaging protrusion extended from the flexible locking piece.

When the locking releasing part is depressed, the flexible locking piece is displaced to disengage from the locking protrusion.

BRIEF DESCRIPTION OF THE DRAWINGS

FIG. 5A is a perspective view showing one modification of the locking mechanism;

FIGS. 5B and 5C are enlarged views of the locking mechanism;

FIG. 6 is a sectional view showing the male and female connectors which have been locked together by the locking mechanism of FIG. 5;

DETAILED DESCRIPTION OF THE PREFERRED EMBODIMENTS

Figure 1:
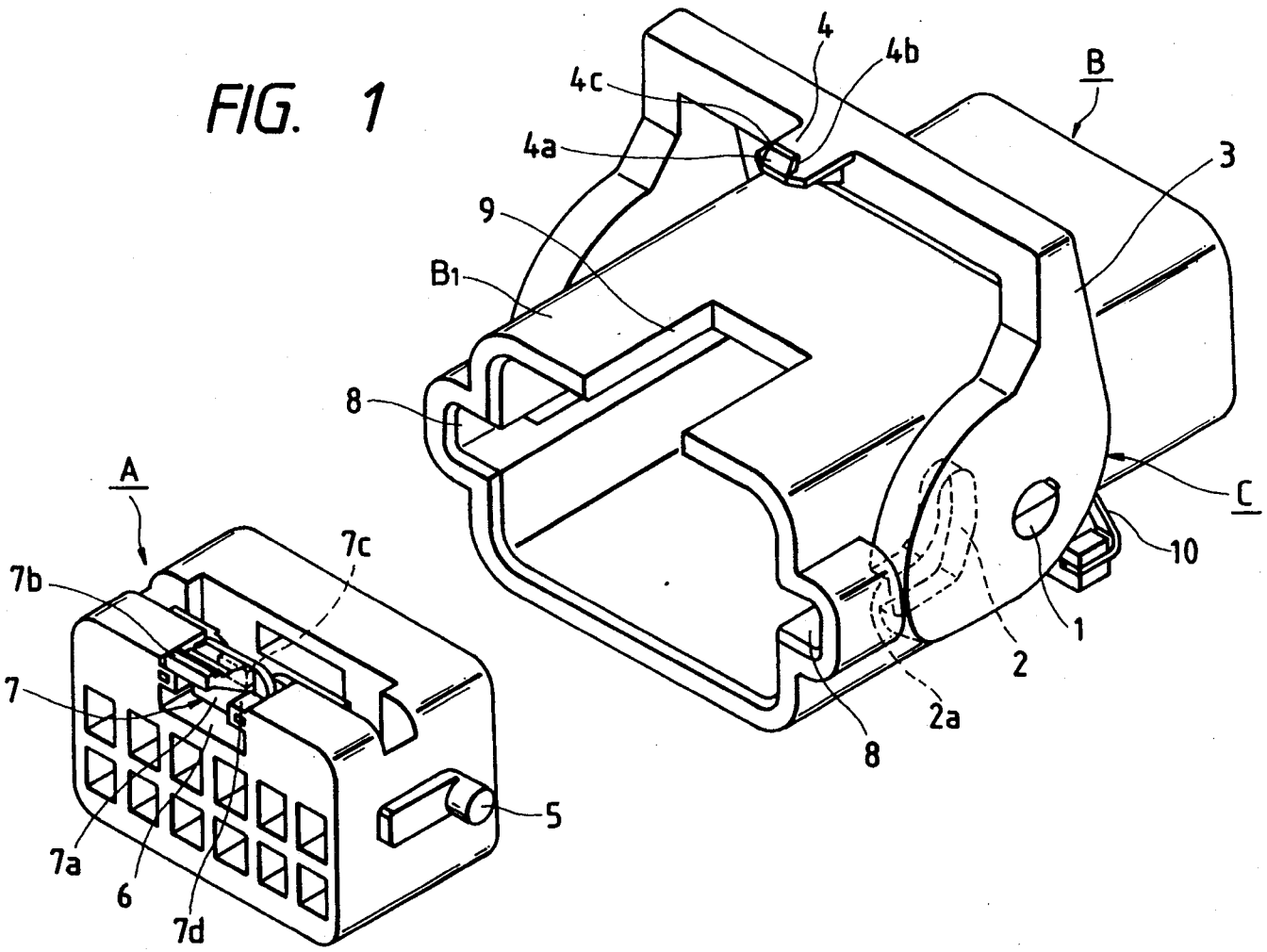
FIG. 1 is a perspective view showing the male and female connectors of a connector assembly of one embodiment of the present invention.
Figure 2:
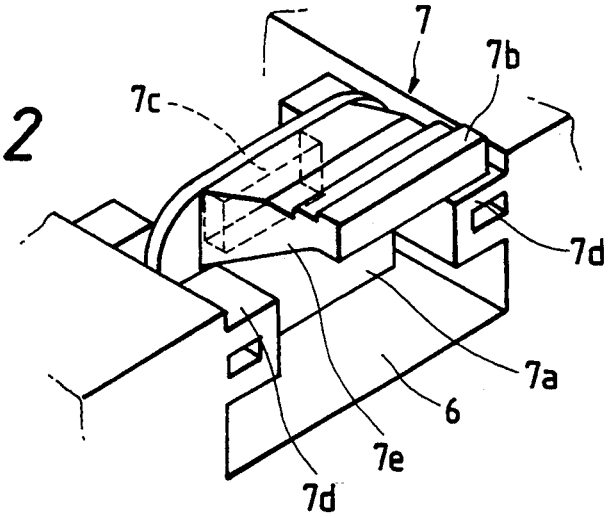
FIG. 2 is an enlarge perspective view showing a locking section of the present invention.

FIG. 1 is a perspective view showing a connector assembly comprising male and female connectors, which constitutes one embodiment of this invention. In FIG. 1, reference character A designates the male connector of synthetic resin; B, the female connector of synthetic resin; C, an engaging drive lever which is swingably mounted on the female connector B through supporting shafts 1. The drive lever C includes cam grooves 2 in both end portions, and an operating part 3 with a lock engaging piece 4. The lock engaging piece 4 is made up of a locking protrusion 4*c* having a tapered engaging guide surface 4*a* and an engaging surface 4*b*.

The male connector A has driven pins 5 on its both side walls. A substantially L-shaped lock 7 is provided in a recess 6 formed in the outer wall of the male connector A. The lock 7 is designed as follows: In the recess 6, a flexible locking plate 7*a* is provided upright, and a lock releasing part 7*b* is extended from the upper end of the locking plate 7*a* towards the rear end of the male connector A. The flexible locking plate 7*a* has a locking hole 7*c*. Excessive displacement preventing stoppers 7*d* are provided behind the flexible locking plate 7*a*. A pair of reinforcing parts 7*e* are provided between the flexible locking plate 7*a* and the lock releasing part 7*b*.

The front end portion of the female connector B is formed into a hood B1 for receiving the male connector A. Pin guide grooves 8 are formed on both sides of the hood B1 to receive the above-described driven pins 5, respectively. The pin guide grooves 8 are in alignment with the inlets (or openings) 2*a* of the cam grooves 2 of the engaging drive lever C when the latter is not operated, respectively. The hood B1 has a cut 9, into which the lock engaging piece 4 is inserted. The lever C is held upright by a leaf spring 10, when not operated.

The male and female connectors A and B designed as described above engage with each other as follows: First, the driven pins 5 are moved through the pin guide grooves 8 into the cam grooves 2, respectively. When, under this condition, the lever C is turned by using the operating part 3, the male connector A is pulled into the hood B1 of the female connector B with the aid of the cam grooves 2 and the driven pins 5. When the male and female connectors have been engaged with each other, the lock engaging piece 4 is engaged with the lock 7, so that the male and female connectors are held engaged with each other. The male and female connectors A and B have terminal accommodating chambers, respectively, which are confronted with each other when the connectors are engaged with each other. Metal terminals (not shown) are fixedly set in those terminal accommodating chambers. Upon engagement of the male and female connectors, the metal terminals set in the terminal accommodating chamber of the male connector are connected to those set in the terminal accommodating chamber of the female connector, respectively.

When the male and female connectors are engaged with each other, the locking protrusion 4*c* of the lock engaging piece 4 abuts against the flexible locking plate 7*a* of the lock 7 with the aid of the tapered engaging guide surface 4*a* to displace the flexible locking plate 7*a* backwardly while entering the locking hole 7*c*. Thereafter, the flexible lock plate 7*a* is restored, and the engaging surface 4*b* is locked to the locking hole 7*c* of the flexible locking plate 7 thus restored (cf. FIG. 3).

Figure 3:
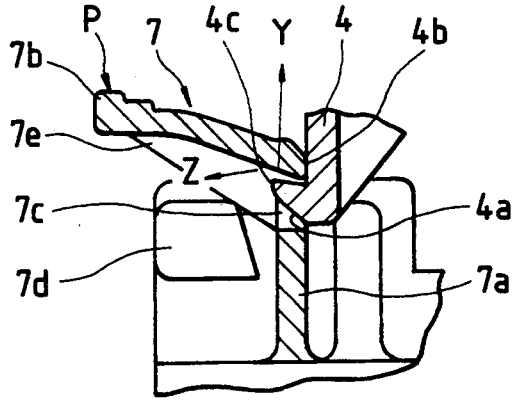
FIG. 3 is a sectional view showing essential components of the male and female connectors which are locked to each other.
Figure 4:
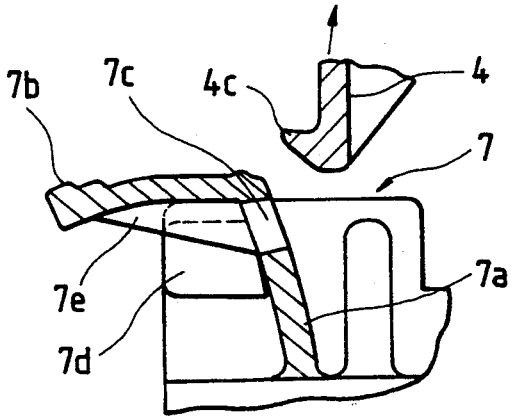
FIG. 4 is a sectional view showing essential components of the male and female connectors the locking of which is released.
Figure 7:
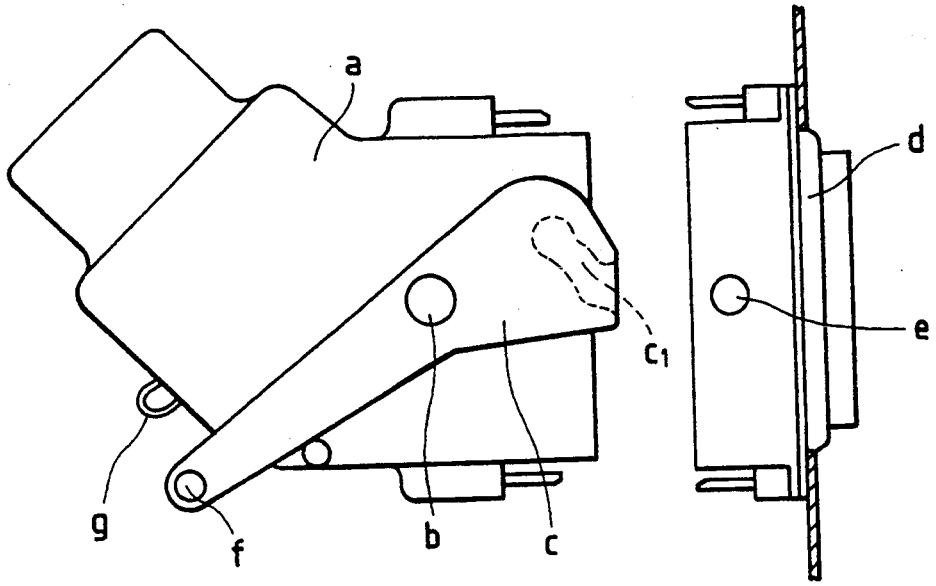
FIG. 7 PRIOR ART
FIG. 7 is a side view showing the male and female connectors of a conventional connector assembly which have been separated from each other.
Figure 8:
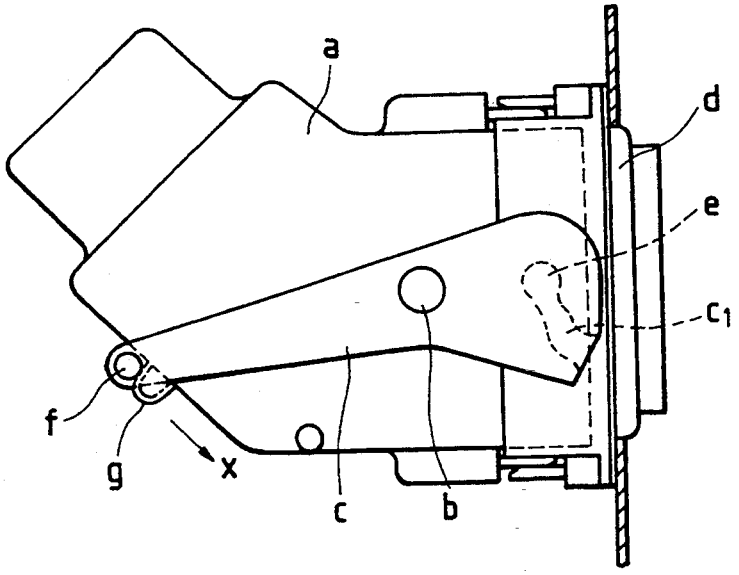
FIG. 8 PRIOR ART
FIG. 8 is a side view showing the male and female connectors of the conventional connector assembly which have been engaged with each other.

When, under the condition that the lever has been locked as shown in FIG. 3, the lock releasing part 7*b* is pushed in the direction of the arrow P, the flexible locking plate 7*a* is displaced backwardly, so that the locking protrusion 4*c* is disengaged from the locking hole 7*a*, whereby the male and female connectors are released from each other (cf. FIG. 4). In this operation, the direction Y of the locking holding force crosses the direction Z of the operation of releasing the connectors. This makes it possible not only to increase the locking force but also to release the connectors from each other.

FIG. 5A shows one modification and FIGS. 5*b* and 5C an enlargement thereof, of the above-described locking mechanism. The operating part 3 of the engaging drive lever C has a lock engaging piece 4', which is made up of a locking protrusion 4*c'* with a tapered engaging guide surface 4*a'*. An engaging recess 4*b'* is formed in the engaging surface of the locking protrusion 4*c'*. A lock 7' is provided in the outer wall of the male connector as follows: A flexible locking plate 7*a'* integral with a lock releasing part 7*b'* has a locking recess 7*c'* defining an locking protrusion 7*e'*, as shown in FIG. 5C.

When the male and female connectors are engaged with each other, the locking protrusion 4*c'* of the lock engaging piece 4' abuts against the flexible locking plate 7*a'* of the lock 7' with the aid of the tapered engaging guide surface 4*a'* to displace the flexible locking plate 7' backwardly while entering the locking recess 7*c'*. And, the flexible locking plate 7*a* is restored, and the engaging protrusion 7*e'* is firmly engaged with the engaging recess 4*b'* (cf. FIG. 6).

As was described above, in the locking mechanism according to the invention, the engaging drive lever having the cam grooves and the lock engaging piece is swingably mounted on one of the connectors, the other connector has the driven pins which are engaged with the cam grooves, and the lock which includes the flexible locking piece formed upright in the outer wall of the other connector, and the lock releasing part extended from the free end portion of the flexible locking piece. After the connectors have been engaged with each other, with the locking protrusion of the lock engaging part engaged with the flexible locking piece the lock releasing part is depressed to move the flexible locking piece across the direction of the force of holding the connectors locked, to release the connectors from each other. Hence, the locking mechanism is not only able to increase the force of holding the connectors locked but also able to release the connectors from each other with ease. Furthermore, the locking mechanism is so modified that, when the pair of connectors are engaged with each other, the engaging recess formed in the engaging surface of the locking protrusion is engaged with the engaging protrusion extended from the flexible locking piece, which further increases the force of holding the connectors locked.

What is claimed is:

1. A locking mechanism for a connector assembly of low engaging/disengaging force type comprising:

a pair of connectors which are engageable with each other;

an engaging drive lever swingably mounted on one of the connectors, the engaging drive lever being provided with cam grooves;

driven pins provided with the other connector, the driven pins being engageable with the cam grooves;

locking means for locking a pair of the connectors to each other, the locking means provided with the engaging drive lever and the other connector, a locking holding force direction crossing a connector releasing force direction when the connectors are released; and spring means, provided on the engaging drive lever, for returning the engaging drive lever to a disengaged position when the locking means is released.

2. A locking mechanism for a connector assembly of low engaging/disengaging force type as claimed in claim 1, wherein the locking means includes:

a lock engaging member including a lock engaging projection, the lock engaging member being arranged on the engaging drive lever;

a flexible locking member for engaging the lock engaging member, the flexible locking member having a locking releasing member extend from a free end portion of the flexible locking member, the flexible locking member being mounted on the other connector.

3. A locking mechanism for a connector assembly of low engaging/disengaging force type as claimed in claim 2, wherein after the connectors have been engaged with each other, the lock releasing member is depressed to move the flexible locking member so as to release the connectors from each other.

4. A locking mechanism for a connector assembly of low engaging/disengaging force type as claimed in claim 2, wherein the locking engaging projection has an engaging recess and the flexible locking member has a locking protrusion for engaging the engaging recess.

* * * * *